US011139130B1

(12) United States Patent
Caldwell et al.

(10) Patent No.: US 11,139,130 B1
(45) Date of Patent: Oct. 5, 2021

(54) SAFETY SWITCH

(71) Applicant: ARCACHON HOLDINGS LLC, Clearwater, FL (US)

(72) Inventors: Jamey Marcus Caldwell, Carthage, NC (US); Gary Leegate, Clearwater, FL (US)

(73) Assignee: ARCACHON HOLDINGS LLC, Clearwater, FL (US)

( * ) Notice: Subject to any disclaimer, the term of this patent is extended or adjusted under 35 U.S.C. 154(b) by 0 days.

(21) Appl. No.: 17/171,459

(22) Filed: Feb. 9, 2021

(51) Int. Cl.
*H01H 36/00* (2006.01)
*G08B 5/36* (2006.01)
*A42B 3/04* (2006.01)

(52) U.S. Cl.
CPC ..... *H01H 36/0013* (2013.01); *H01H 36/006* (2013.01); *H01H 36/0033* (2013.01); *A42B 3/0453* (2013.01); *G08B 5/36* (2013.01); *H01H 2215/044* (2013.01); *H01H 2239/03* (2013.01)

(58) Field of Classification Search
CPC ..... H01H 36/00–36/02; H01H 2239/03
See application file for complete search history.

(56) References Cited

U.S. PATENT DOCUMENTS 4,195,328 A 3/1980 Harris, Jr.
4,901,210 A 2/1990 Hanabusa
5,414,405 A 5/1995 Hogg et al.
5,633,623 A 5/1997 Campman
5,748,891 A 5/1998 Fleming
5,966,226 A 10/1999 Gerber
6,201,495 B1 3/2001 Lemelson et al.
6,213,623 B1 4/2001 Campman
6,283,620 B1 9/2001 Taylor
6,545,632 B1 4/2003 Lyons
7,021,790 B2 4/2006 Parsons
7,023,004 B2 4/2006 Ford et al.
7,221,263 B2 5/2007 Moore
7,315,036 B2 1/2008 Ford et al.
7,505,279 B2 3/2009 Ohtaki et al.
7,722,205 B2 5/2010 Kim
7,831,150 B2 11/2010 Roes et al.
8,444,291 B2 5/2013 Swan et al.
8,477,492 B2 7/2013 Rothkopf et al.
8,485,686 B2 7/2013 Swan et al.
8,534,861 B2 9/2013 Leegate et al.
8,573,797 B2 11/2013 Spartano et al.
8,672,504 B2 3/2014 Kramer
(Continued)

*Primary Examiner* — Ramon M Barrera
(74) *Attorney, Agent, or Firm* — Larson & Larson, P.A.; Frank Liebenow; Justin P. Miller

(57) ABSTRACT

A safety switch includes an actuator that has a first possible actuator position and a second possible actuator position and a blocker that has a first possible blocker position and a second possible blocker position. The first possible blocker position overlaps with the second possible actuator position. The safety switch includes a device for generating an electrical signal representative of a current position of the actuator. When the actuator is in the first possible actuator position and the blocker is in the first possible blocker position, the blocker prevents movement of the actuator from the first possible actuator position to the second possible actuator position without first moving the blocker from the first possible blocker position to the second possible blocker position.

15 Claims, 6 Drawing Sheets

(56) References Cited

U.S. PATENT DOCUMENTS

| | | | | |
|---|---|---|---|---|
| 9,144,261 | B2 | 9/2015 | Leegate et al. | |
| 9,175,837 | B1 | 11/2015 | Leegate et al. | |
| 9,175,838 | B1 | 11/2015 | Leegate et al. | |
| 9,341,714 | B2 | 5/2016 | Leegate et al. | |
| 9,476,982 | B2 | 10/2016 | Leegate et al. | |
| 9,746,561 | B2 | 8/2017 | Leegate et al. | |
| 2008/0011592 | A1* | 1/2008 | Liebert ..... | H01H 9/06 200/43.11 |
| 2008/0134562 | A1 | 6/2008 | Teetzel | |
| 2008/0216699 | A1 | 9/2008 | McAleer et al. | |
| 2009/0144872 | A1 | 6/2009 | Lebel | |
| 2010/0128468 | A1 | 5/2010 | Ong et al. | |
| 2011/0170280 | A1 | 7/2011 | Soto | |
| 2013/0114275 | A1 | 5/2013 | Cristofaro | |
| 2016/0088891 | A1 | 3/2016 | Walsh | |
| 2016/0309826 | A1 | 10/2016 | Anderson | |

* cited by examiner

SAFETY SWITCH

FIELD

This invention relates to the field of electrical switches and more particularly to a multi-position electrical switch that prevents inadvertent operation.

BACKGROUND

There are many known two position switches, for example, toggle switches and slide switches. Such switches are usually used to turn on/off electrical circuits such as lights, fans, etc. In general, an inadvertent operation of such switches does not result in danger to the operator and the operator, after inadvertent operation of such a switch, simply moves the switch back to the intended state and moves on. Unfortunately, inadvertent operation of certain switches invoke danger, for example, inadvertent operation of an eject switch in a jet fighter will likely result in that jet fighter crashing after the pilot is ejected. So that such a switch does not get activated, in the current art, the switch is often covered and the pilot must first remove the cover before activating the switch. There are several other situations in which inadvertent operation of a switch will result in danger to the operator of that switch, very often in combat situations.

There are also many multi-position switches (those with greater than two positions) that are known and used today. Take for example, a rotary switch used to select an input of a stereo system. In a first position, an amplifier is connected to a turntable, in a second position, the amplifier is connected to an FM tuner, and in a third position, the amplifier is connected to a CD player. Such switches move freely between positions and it is non-consequential if such a switch is moved from a first position to a third position in a single movement as this would only change the input of the amplifier from the turntable to the CD player.

In some situations, there is a need to prevent a multi-position switch from moving from a first position beyond a second position, for example, moving from the first position to a third or fourth position. Take for example the rotary switch of U.S. Pat. No. 7,315,036 to Ford, et al. In this, a signaling device is disclosed having light emitters, some of the light emitters operate in the visible spectrum (e.g., white light) and some work in the non-visible spectrum (e.g., infrared light). A rotary switch sets which of the emitters emit light (white light, infrared light, or no light). When such a signaling device is used in a military operation, it is often important for covert reasons, to switch from an off-mode into a non-visible mode without switching into a visible mode, as the enemy could be able to see the wearer if the signaling device is set to visible mode. As such signaling devices are often worn on a helmet, the wearer might not know if the signaling device is emitting visible light. Unfortunately, using the disclosed rotary switch, it would be easy for the wearer who intends to switch from a first position (e.g., off) to a second position (infrared emission); to accidentally switch to a third position (e.g., white light emission), resulting in the inadvertent and, often, dangerous emission of visible light.

What is needed is a safety switch that will prevent inadvertent switching between or into certain positions.

SUMMARY

In one embodiment, a safety switch is disclosed including an actuator that has a first possible actuator position and a second possible actuator position and a blocker that has a first possible blocker position and a second possible blocker position. The first possible blocker position overlaps with the second possible actuator position. The safety switch includes a device for generating an electrical signal representative of a current position of the actuator. When the actuator is in the first possible actuator position and the blocker is in the first possible blocker position, the blocker prevents movement of the actuator from the first possible actuator position to the second possible actuator position without first moving the blocker from the first possible blocker position to the second possible blocker position. In some such embodiments, both the actuator and blocker slide along a guide that has detents in each position.

In another embodiment, a method of safely switching a state of an electrical apparatus is disclosed. The method includes starting with an actuator in a first actuator position and a blocker being adjacent to the actuator in a first blocker position. In a first step, moving the blocker from the first blocker position to a second blocker position that is distal from the actuator and in a second step, moving the actuator from the first actuator position to a second actuator position which is the same as the first blocker position. The actuator is not able to be moved from the first actuator position to the second actuator position without first moving the blocker from the first blocker position to the second blocker position.

In another embodiment, a safety switch is disclosed including an actuator. The actuator is physically interfaced to a permanent magnet and has a first possible actuator position and a second possible actuator position. The safety switch has a blocker that has a first possible blocker position and a second possible blocker position, the first possible blocker position overlaps with the second possible actuator position. There is a magnetic sensor situated such that the magnetic sensor generates a first electrical signal when the actuator is in the first possible actuator position in which the permanent magnet is in proximity of the magnetic sensor and the magnetic sensor generates a second electrical signal when the actuator is in the second possible actuator position in which the permanent magnet is distal from the magnetic sensor. When the actuator is in the first possible actuator position and the blocker is in the first possible blocker position, the blocker prevents movement of the actuator from the first possible actuator position to the second possible actuator position without first moving the blocker from the first possible blocker position to the second possible blocker position.

Note that when the disclosed switching system is integrated into a marker system, it is important to pass as much light as possible from within the enclosure of the marker system to outside of the enclosure. Therefore, in some embodiments, both the actuator(s) and blocker(s) are made of a clear or translucent material (except for the small magnet within the actuators), thereby permitting optimal light from the light emitters to escape the marker system for a given emitter input power, which is more light output than if the actuator(s) and blocker(s) are made of an opaque material.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
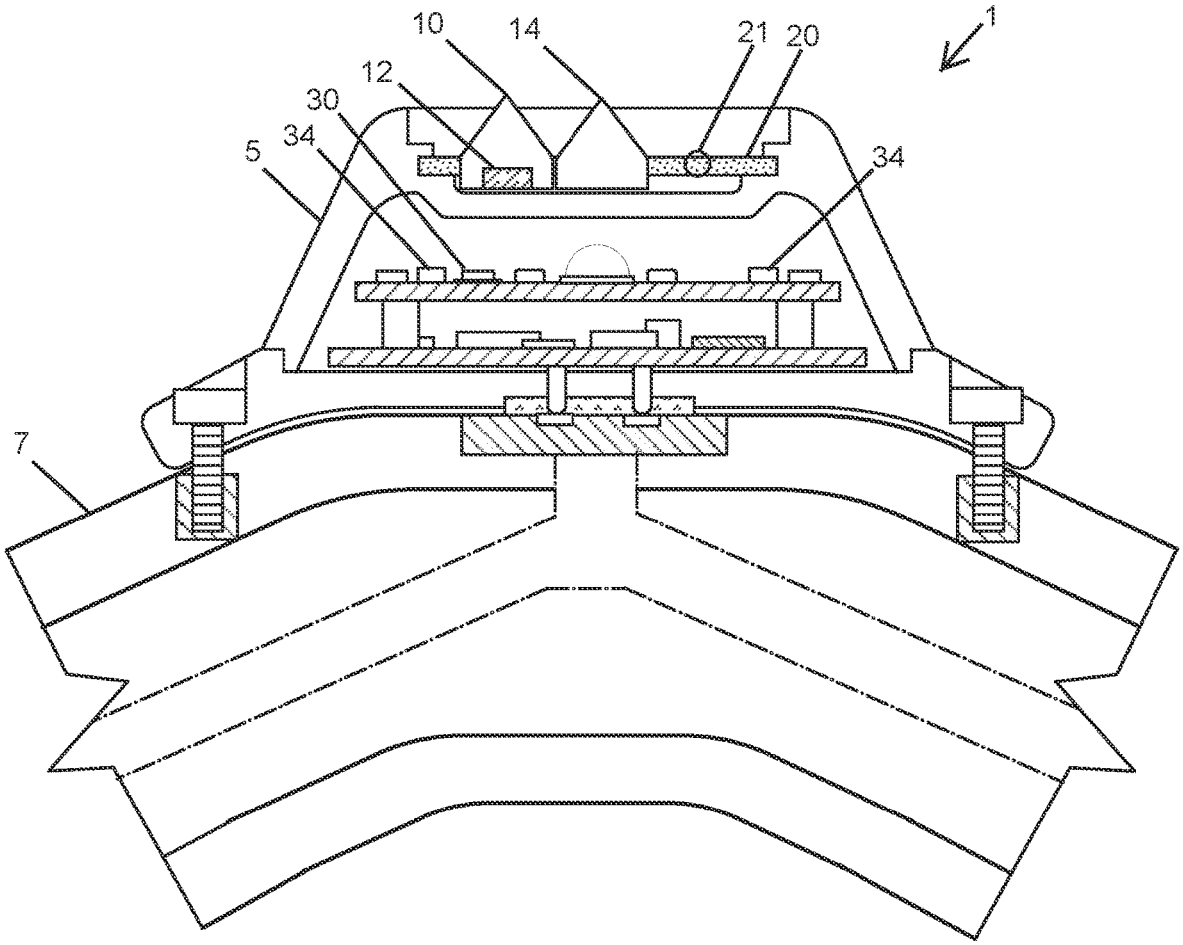
FIGS. 1-3 illustrate schematic views of a two-position safety switch.

Reference will now be made in detail to the presently preferred embodiments of the invention, examples of which are illustrated in the accompanying drawings. Throughout the following detailed description, the same reference numerals refer to the same elements in all figures.

Throughout this description, for clarity reasons only, the safety switch 1 is described as part of a marker system 5 that is affixed to a helmet 7. In this, other parts of the marker system 5 such as light emitters 34 are shown but do not limit the overall concept and inventiveness of the safety switch 1. Further, it is fully anticipated that the safety switch 1 be constructed as an integral device using any known electrical connecting device such as magnetic switches or sensors (e.g., reed relays), optical switches and light blockers, electrical contacts, etc. In the examples shown here, only magnetic switches are shown for clarity reasons.

It is important for a marker system 5 to emit as much light as possible given the limited power obtained from an internal power source (e.g., battery). In such an application of a marker system 5, as most of the safety switch 1 is fabricated from clear or translucent materials so as to transmit as much light from the light emitters 34 outside of the enclosure 5, some of which light passes through the actuator 10 and blocker 14. In such, the size of the permanent magnet 12 is kept to a minimum as required to be sensed by the magnetic switch 30, thereby the permanent magnet 12 blocks as little light as possible when the light emitters 30 emit light.

Figure 2:
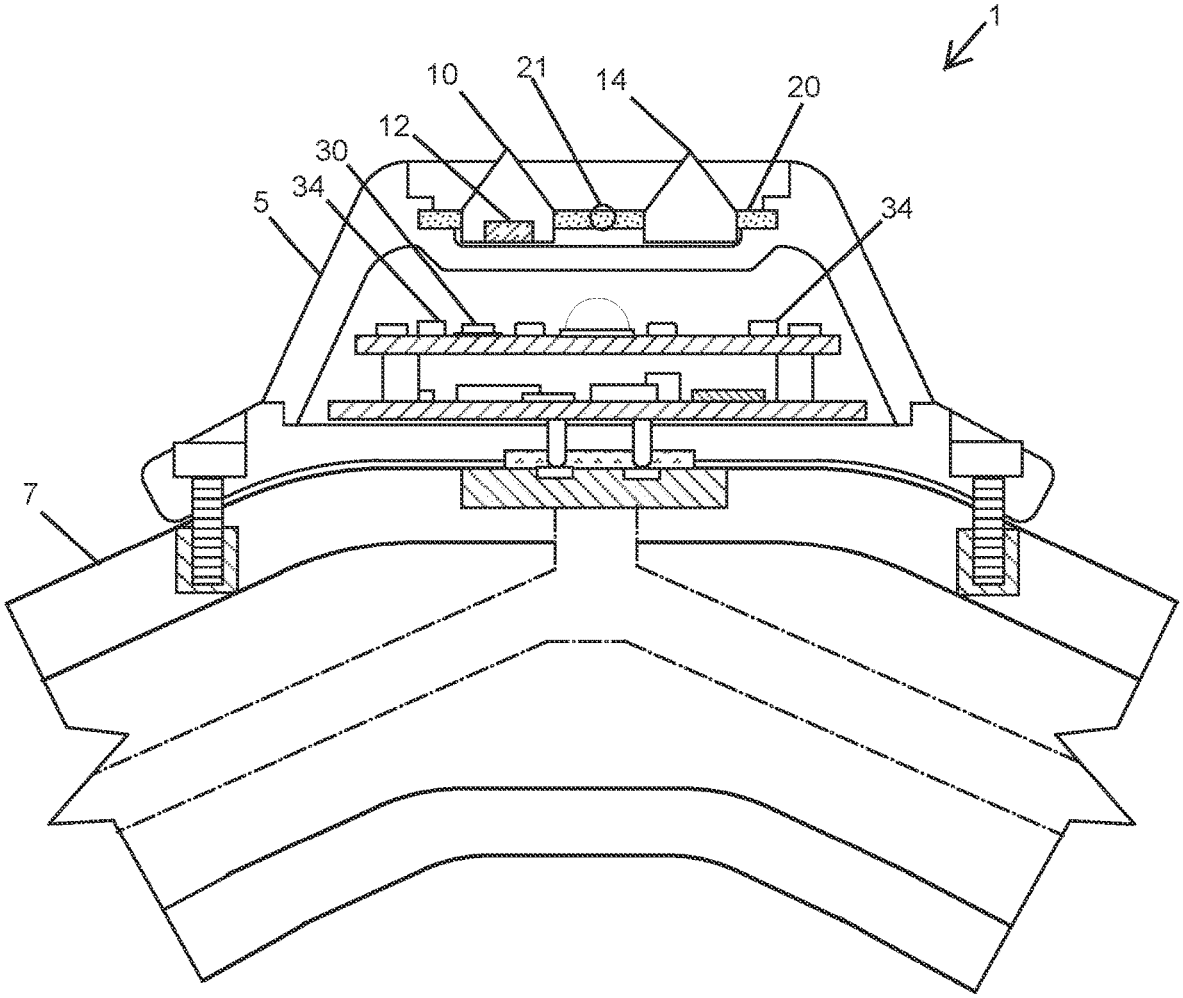
Figure 3:
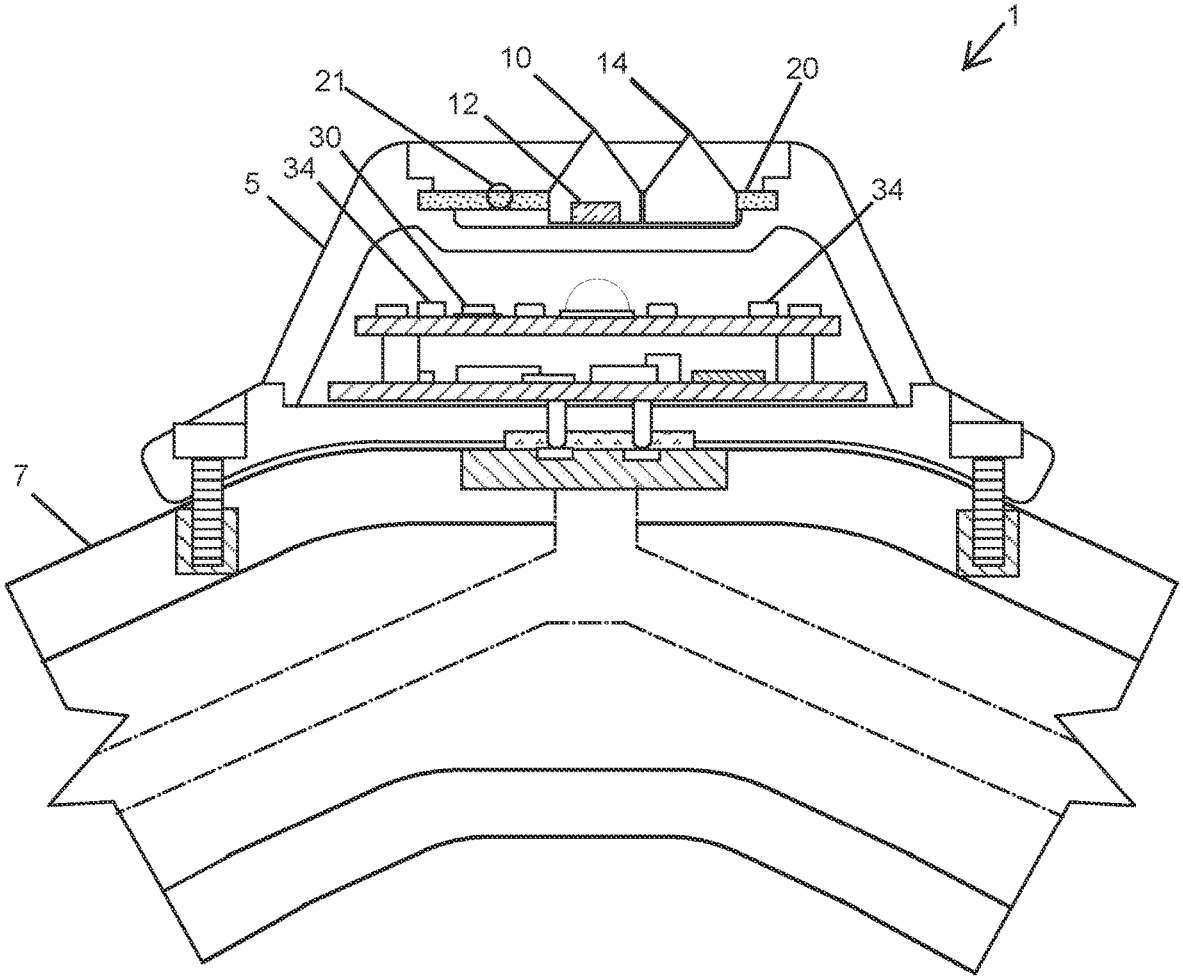

Referring to FIGS. 1-3, schematic views of safety switch 1 having two-positions are shown. In this example, the position of the actuator 10 determines the operation of the safety switch 1. The actuator 10 includes a permanent magnet 12. When the actuator 10 is in a first actuator position over the magnetic switch 30 (e.g., any magnetic sensor such as a reed switch) as being in the left-most position as in FIGS. 1 and 2, the magnetic switch 30 is exposed to a magnetic field of the permanent magnet 12 and, for example, is closed emitting a first electrical signal to invoke a specific operation of the connected device (e.g., invoking the marker system 5 to not emit light from the light emitters 34 and stay dark). When the actuator 10 is moved away from the magnetic switch 30 as being in second actuator position (the center position as in FIG. 3), the magnetic switch 30 is exposed to insufficient magnetic force from the permanent magnet 12 and, for example, is open emitting a second electrical signal that invokes a second specific operation of the connected device (e.g., invoking the marker system 5 to emit light from the light emitters 34). As discussed, there are situations in which inadvertent operation of a switch will lead to an operation of the connected device that is often dangerous such as in the example of a military operation in which a casual brush of a switch of the prior art will cause a marker system to emit light and expose the location of the wearer. To prevent such operation, a blocker 14 prevents the actuator 10 from moving as in order to move the blocker 14, the actuator 10 must push the blocker along the guide 20 and forces of detents 21 along the guide 20 prevent movement of both the actuator 10 and the blocker 14 at the same time. Therefore, in order for the user to move the actuator 10, the user must first move the blocker 14 from the first blocker position (center position as shown in FIG. 2), to the second blocker position (right-most position as shown in FIG. 3), then move the actuator 10 from the first actuator position (left-most position as shown in FIG. 1) to the second actuator position (center position as shown in FIG. 3). Therefore, an inadvertent action of pushing only on the actuator 10 will not cause the actuator 10 to move as it is blocked by the blocker 14 and will not invoke a different operation of the safety switch 1 and any connected circuitry. Note that the second actuator position overlaps with the first blocker position and, therefore, the actuator 10 cannot be in the second actuator position at the same time that the blocker 14 is in the first blocker position.

Likewise, when the actuator 10 is in the second actuator position (center position) and the blocker 14 is in the second blocker position (right-most position), the safety switch 1 cannot be inadvertently changed back to the original position (e.g., cannot progress for the mode shown in FIG. 3 back to the mode shown in FIG. 1) without first moving the actuator 10 to the first actuator position (left-most position) and then moving the blocker 14 to the first blocker position (center position). Note that in this embodiment, once the actuator 10 is moved to the first actuator position (left-most position), the magnetic switch 30 is exposed to a magnetic field of the permanent magnet 12 even before the blocker 14 is moved to the first blocker position (center position). This results in closing of the magnetic switch 30, invoking the specific operation of the connected device (e.g., preventing emission of light) which is not a safety concern. If there is a safety concern with this specific operation, then other switch configurations, for example, as shown in FIGS. 4-6 are preferred.

Note that although the permanent magnet 12 is shown in the actuator 10, it is equally anticipated that the permanent magnet be in the blocker 14 and the location of the magnetic switch 30 be either centrally located or located beneath the right-most position to provide the safe operation of the safety switch 1.

Figure 4:
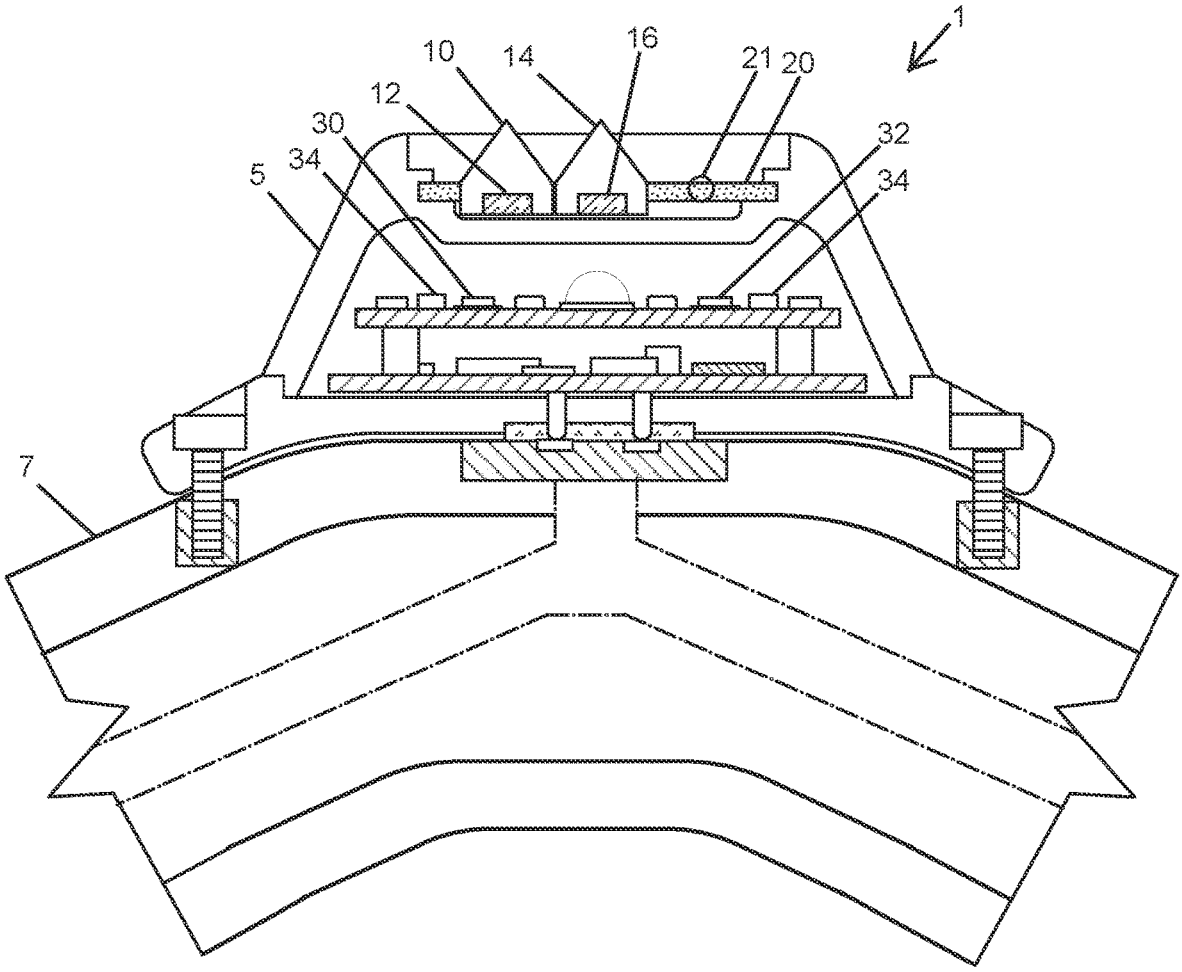
FIGS. 4-6 illustrate schematic views of a three-position safety switch.
Figure 5:
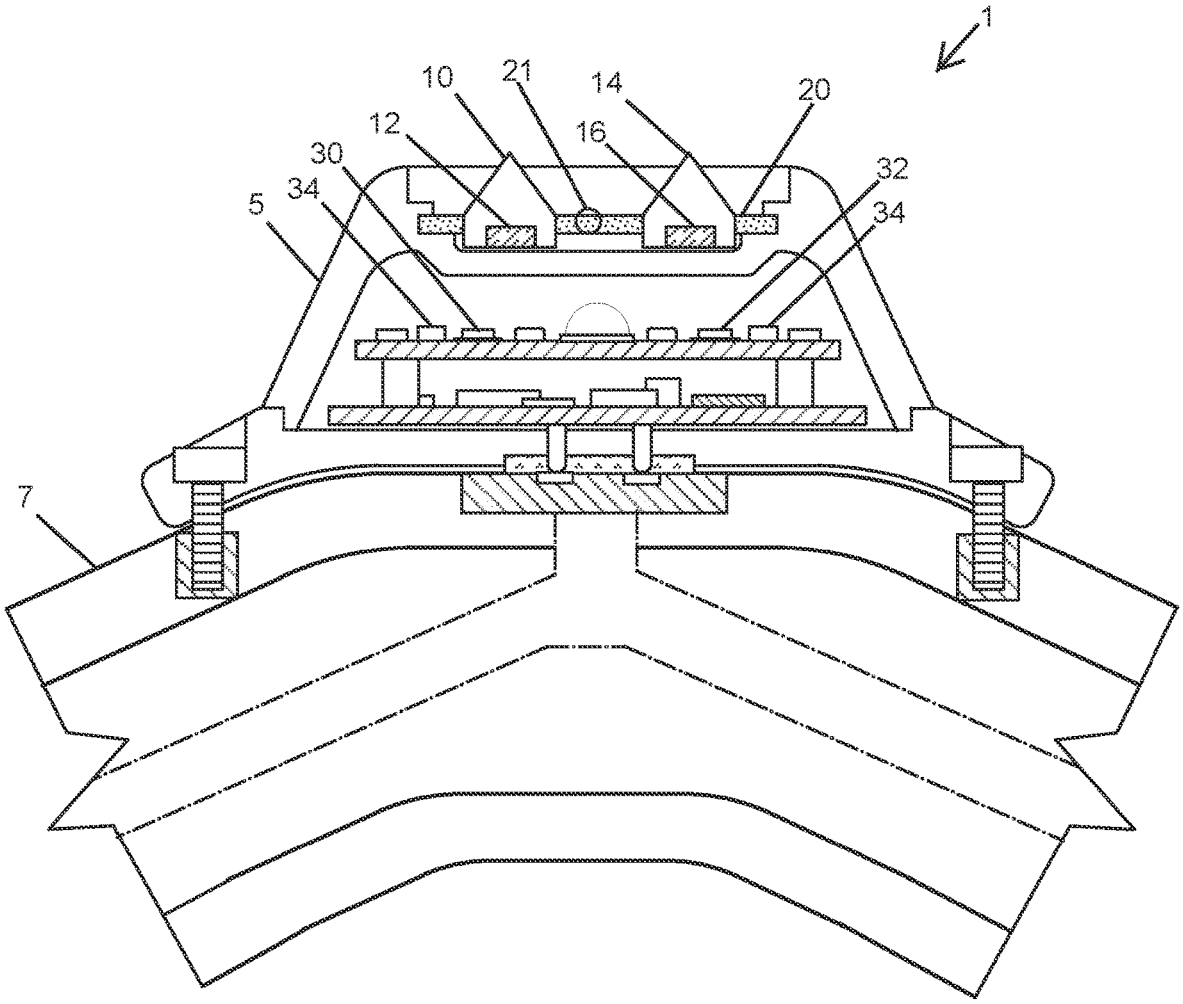
Figure 6:
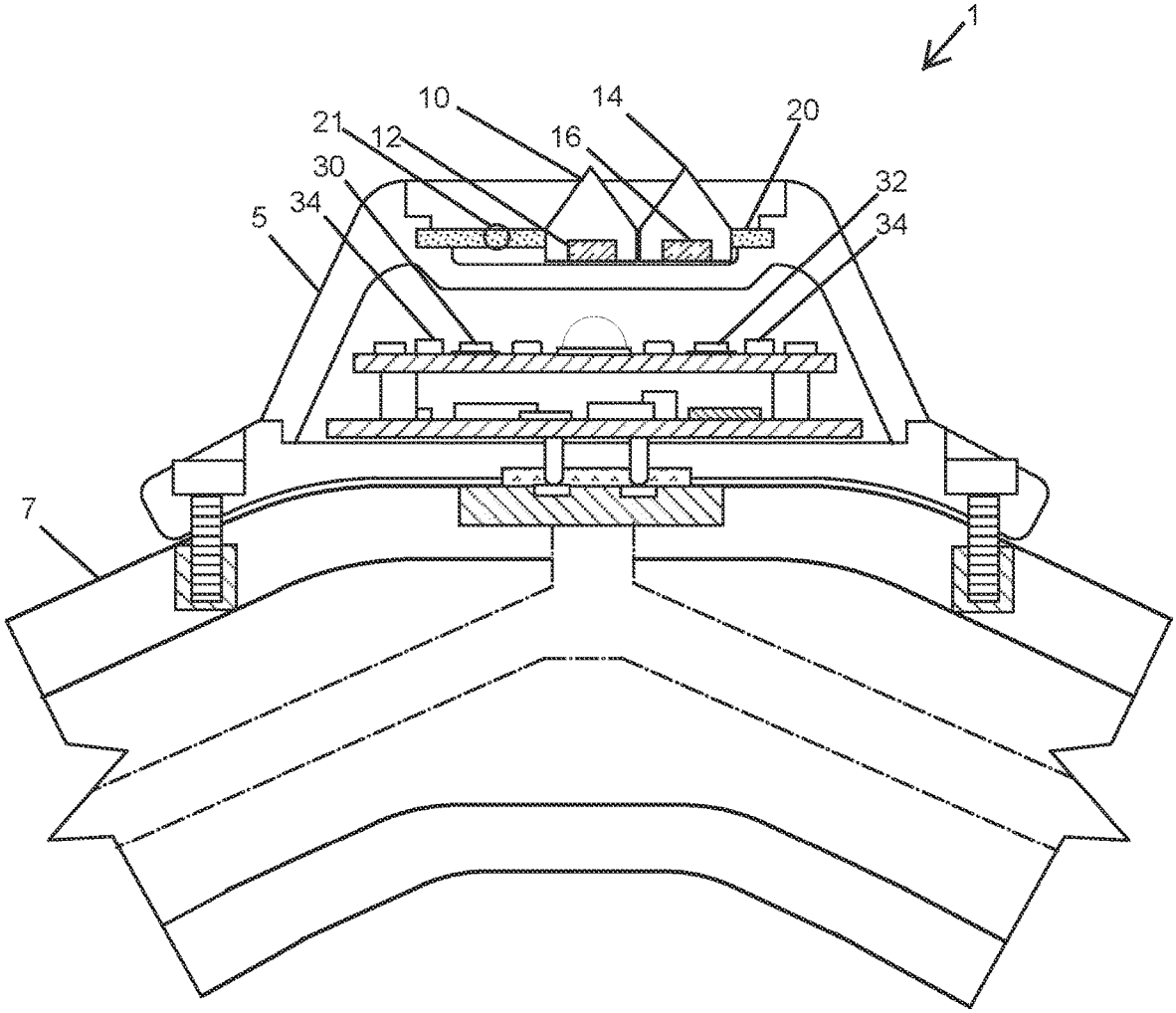

Referring to FIGS. 4-6, schematic views of a safety switch 1 having three-positions are shown. In this example, the position of the both the actuator 10 and the blocker 14 determines the operation of the safety switch 1. In this example, the actuator 10 includes a permanent magnet 12 that moves with the actuator 10 and the blocker 14 includes a second permanent magnet 16 that moves with the blocker 14. When the actuator 10 is over the magnetic switch 30 (e.g., a reed switch) as being in the first actuator position (left-most position as in FIGS. 4 and 5), the magnetic switch 30 is exposed to a magnetic field of the permanent magnet 12 and, for example, is closed, invoking a first specific operation of the connected device (e.g., invoking the marker system 5 to not emit light from the light emitters 34 and stay dark). When the actuator 10 is moved away from the magnetic switch 30 as being in the second actuator position (center position as in FIG. 6), the magnetic switch 30 is exposed to insufficient magnetic force from the permanent magnet 12 and, for example, is open, invoking a second specific operation of the connected device (e.g., invoking the marker system 5 to emit non-visible light from the light emitters 34). The blocker 14 includes the second permanent magnet 16 and, therefore, when the blocker is in the first blocker position (center position as shown in FIG. 5), the magnetic force from the second permanent magnet 16 is insufficient to energize a second magnetic switch 32, but when the blocker 14 is in the second blocker position (right-most position as shown in FIG. 6), force from the second permanent magnet 16 is sufficient and energizes the second magnetic switch 32. Therefore, an additional mode of operation is possible, for example, emitting visible light only when the blocker 14 is in the second blocker position and the actuator 10 is in the second actuator position.

The following table indicates one possible set of operations based upon positions of the actuator 10 and blocker 14:

| | Actuator Position | Blocker Position |
|---|---|---|
| No emission | $1^{st}$ | $1^{st}$ |
| Invisible light | $1^{st}$ | $2^{nd}$ |
| Visible light | $2^{nd}$ | $2^{nd}$ |

The following table indicates another possible set of operations based upon positions of the actuator 10 and blocker 14:

| | Actuator Position | Blocker Position |
|---|---|---|
| No emission | $1^{st}$ | $1^{st}$ or $2^{nd}$ |
| Visible light | $2^{nd}$ | $2^{nd}$ |

As above, the blocker 14 prevents the actuator 10 from moving as in order to move the blocker 14, the actuator 10 must push the blocker along the guide 20 and forces of friction prevent movement of both the actuator 10 and the blocker 14 at the same time. Therefore, in order for the user to move the actuator 10 from the first actuator position (left-most position as in FIG. 4) to the second actuator position (center position as in FIG. 5), the user must first move the blocker 14 from the first blocker position (center position as shown in FIG. 5), to the second blocker position (right-most position as shown in FIG. 6), then move the actuator 10 from the first actuator position (left-most position as shown in FIG. 4) to the second actuator position (center position as shown in FIG. 6). Therefore, an inadvertent action of pushing only on the actuator 10 will not cause the actuator 10 to move as it is blocked by the blocker 14 and will not invoke a different operation of the safety switch 1 and any connected circuitry.

Likewise, when the actuator 10 is in the second actuator position (center) and the blocker 14 is in the second blocker position (right-most position as in FIG. 6), the safety switch 1 cannot be inadvertently changed back to the original position (e.g., cannot progress for the mode shown in FIG. 6 back to the mode shown in FIG. 4) without first moving the actuator 10 to the first actuator position and then moving the blocker 14 to the first blocker position. Therefore, the safety switch 1 of FIGS. 4-6 has three modes of operation. A first mode in which the actuator 10 is in the first actuator position and the blocker 14 is in the first blocker position; a second mode in which the actuator 10 is in the first actuator position and the blocker 14 is in the second blocker position; and a third mode in which the actuator 10 is in the second actuator position and the blocker 14 is in the second blocker position. In this, the connected circuit is able to use the three distinct modes to provide safe operation. In the example of a marker system, the marker system is able to use the first mode to invoke darkness and the third mode to invoke emission of visible light (ignoring the second mode) or the marker system is able to use all three modes, the first mode being dark, the second mode being emission of non-visible light (e.g., infrared light), and the third mode being emission of visible light. In such, by virtue of the blocker 14 preventing the actuator 10 from moving from the first actuator position to the second actuator position until the blocker is first moved from the first blocker position to the second blocker position, it is impossible for the user to advertently or inadvertently switch directly from the first mode to the third mode by pushing the actuator 10 while the blocker 14 is in the first blocker position. Therefore, the user must advertently first move the blocker 14 from the first blocker position as in FIG. 4 to the second blocker position as in FIGS. 5 and 6, before moving the actuator 10 from the first actuator position as in FIGS. 4 and 5 to the second actuator position as in FIG. 6.

Note that it is fully anticipated that the safety switch 1 have more than three positions such as four positions with any number of modes as defined by the number of permanent magnets 12/16 and magnetic switches 30/32 and the locations of such in one or more actuators 10 and blockers 14. For example, a safety switch 1 having two actuators 10 each with a permanent magnet 12 alternating with two blockers 14 without permanent magnets 12 and several magnetic switches 30/32. In this, five unique modes are possible if there is a single blank position as in the above description, though more unique modes are anticipated by providing additional blank positions.

Again, although shown using permanent magnets 12/14 and magnetic switches 30/32, the same safety switch 1 is anticipated to use any known device that converts physical position into an electrical signal including electrical contacts, magnetic sensors, and light interrupter/sensors.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A safety switch comprising:

an actuator, the actuator having a first possible actuator position and a second possible actuator position;

a blocker, the blocker having a first possible blocker position and a second possible blocker position, the first possible blocker position overlapping with the second possible actuator position; and means for generating an electrical signal representative of a current position of the actuator;

whereas when the actuator is in the first possible actuator position and the blocker is in the first possible blocker position, the blocker prevents movement of the actuator from the first possible actuator position to the second possible actuator position without first moving the blocker from the first possible blocker position to the second possible blocker position;

wherein the actuator and the blocker are made from a material that is clear or translucent.

2. The safety switch of claim 1, wherein the means for generating the electrical signal representative of the current position of the actuator comprises a permanent magnet that is mechanically coupled to the actuator and a magnetic sensor, the magnetic sensor situated such that the magnetic sensor generates the electrical signal only when the actuator is in the first possible actuator position in which the permanent magnet is in proximity of the magnetic sensor.

3. The safety switch of claim 1, wherein the means for generating the electrical signal representative of the current position of the actuator comprises a permanent magnet that is mechanically coupled to the actuator and a magnetic sensor, the magnetic sensor situated such that the magnetic sensor generates the electrical signal only when the actuator is in the second possible actuator position in which the permanent magnet is in proximity of the magnetic sensor.

4. The safety switch of claim 1, wherein the means for generating the electrical signal representative of the current position of the actuator comprises a permanent magnet that is mechanically coupled to the actuator, a second permanent magnet that is mechanically coupled to the blocker, and two magnetic sensor arranged such that a first magnetic sensor of the two magnetic sensors generates the electrical signal only when the actuator is in the first possible actuator position in which the permanent magnet is in proximity of the magnetic sensor and a second magnetic sensor of the two magnetic sensors generates the electrical signal only when the blocker is in the second possible blocker position in which the second permanent magnet is in proximity of the magnetic sensor.

5. The safety switch of claim 1, wherein the actuator and the blocker are movably positioned within a guide, the guide having detents; one detent for the first actuator position, a second detent for the second actuator position and first blocker position; and a third detent for the second blocker position.

6. A method of safely switching a state of an electrical apparatus, the method comprising:

starting with an actuator in a first actuator position and a blocker being adjacent to the actuator in a first blocker position;

first, moving the blocker from the first blocker position to a second blocker position that is distal from the actuator;

second, moving the actuator from the first actuator position to a second actuator position with is the same as the first blocker position;

whereas moving of the actuator from the first actuator position to the second actuator position is precluded without first moving the blocker from the first blocker position to the second blocker position; and making the actuator and the blocker of a material that permits the passing of light through the actuator and the blocker.

7. The method of claim 6, further comprising electrically sensing whether the actuator is in the first actuator position or in the second actuator position.

8. The method of claim 7 further comprising electrically controlling an electronic device to operate in a specific mode only when the actuator is in the second actuator position.

9. The method of claim 6, further comprising electrically sensing whether the blocker is in the first blocker position or in the second blocker position.

10. The method of claim 6, further comprising electrically sensing whether the actuator is in the first actuator position or in the second actuator position and electrically sensing whether the blocker is in the first blocker position or in the second blocker position.

11. The method of claim 10, further comprising electrically controlling an electronic device to operate in a specific mode only when the actuator is in the second actuator position and the blocker is in the second blocker position.

12. The method of claim 6, further comprising forcing the actuator and blocker to travel along a guide, the guide having detents that define the first actuator position; the second actuator position and the first blocker position; and the second blocker position.

13. A safety switch comprising:

an actuator, the actuator physically interfaced to a permanent magnet, the actuator having a first possible actuator position and a second possible actuator position defined by a first detent and a second detent respectfully located along a guide which movably supports the actuator;

a blocker, the blocker having a first possible blocker position and a second possible blocker position, the first possible blocker position overlapping with the second possible actuator position defined by the second detent and a third detent respectfully located along the guide which movably supports the blocker; and a magnetic sensor, the magnetic sensor situated such that the magnetic sensor generates a first electrical signal when the actuator is in the first possible actuator position in which the permanent magnet is in proximity of the magnetic sensor and the magnetic sensor generates a second electrical signal when the actuator is in the second possible actuator position in which the permanent magnet is distal from the magnetic sensor;

whereas when the actuator is in the first possible actuator position and the blocker is in the first possible blocker position, the blocker prevents movement of the actuator from the first possible actuator position to the second possible actuator position without first moving the blocker from the first possible blocker position to the second possible blocker position.

14. The safety switch of claim 13, further comprising a second permanent magnet that is physically interfaced to the blocker and a second magnetic sensor arranged such that the second magnetic sensor generates a third electrical signal only when the blocker is in the second possible blocker position in which the second permanent magnet is in proximity of the second magnetic sensor and the second magnetic sensor generates a fourth electrical signal only when the blocker is in the first possible blocker position in which the second permanent magnet is in proximity of the second magnetic sensor.

15. The safety switch of claim 13, wherein the actuator and the blocker each comprise a material that permits light to pass through the actuator and the blocker.

* * * * *